United States Patent [19]

Jessop et al.

[11] Patent Number: 4,896,780

[45] Date of Patent: Jan. 30, 1990

[54] FAIL SAFE RELEASIBLE LOCKS FOR CAPPED DISPOSABLE CENTRIFUGE CONTAINERS

[75] Inventors: Paul M. Jessop; David H. Jeffs, both of Salt Lake City, Utah

[73] Assignee: Multi-Technology Inc., Salt Lake City, Utah

[21] Appl. No.: 271,141

[22] Filed: Nov. 14, 1988

Related U.S. Application Data

[62] Division of Ser. No. 191,518, May 9, 1988, Pat. No. 4,830,209.

[51] Int. Cl.[4] ..... B65D 45/00

[52] U.S. Cl. ..... 215/291; 215/273; 215/278; 215/306; 73/864.91; 422/102

[58] Field of Search ..... 215/230, 273, 277, 306, 215/291, 274, 278, 275; 422/101, 102; 494/16; 73/864.91

[56] References Cited

U.S. PATENT DOCUMENTS

| | | | |
|---|---|---|---|
| 321,237 | 6/1885 | Morgan | 215/273 |
| 568,286 | 9/1896 | Waterman | 215/273 |
| 907,166 | 12/1908 | McCloskey | 215/278 |
| 2,447,330 | 8/1948 | Grebmeier | 233/26 |
| 3,071,316 | 1/1963 | Piemonte et al. | 233/26 |
| 3,107,805 | 10/1963 | Asher | 215/1 |
| 3,115,460 | 12/1963 | McCormick | 233/26 |
| 3,199,707 | 8/1915 | Folkman | 73/864.91 X |
| 3,366,320 | 1/1968 | Cho | 233/26 |
| 3,459,369 | 8/1969 | Marks | 233/26 |
| 3,720,502 | 3/1973 | Gropper et al. | 23/292 |
| 3,898,046 | 8/1975 | Ikeda et al. | 23/259 |
| 3,957,653 | 5/1976 | Blecher | 210/518 |
| 4,076,170 | 2/1978 | Chulay et al. | 233/26 |
| 4,080,175 | 3/1978 | Chulay et al. | 23/292 |
| 4,176,756 | 12/1979 | Gellman | 215/274 |
| 4,241,188 | 12/1980 | Materia et al. | 435/296 |
| 4,348,207 | 9/1982 | Cappel | 422/102 X |
| 4,396,381 | 8/1983 | Fanger et al. | 494/85 |
| 4,480,762 | 11/1984 | Thomas | 215/273 |
| 4,610,171 | 9/1986 | Nason | 73/864.91 X |
| 4,652,429 | 3/1987 | Konrad | 422/102 |
| 4,674,640 | 6/1987 | Asa et al. | 215/230 |
| 4,713,219 | 12/1987 | Gerken et al. | 422/102 |
| 4,753,358 | 6/1988 | Virca et al. | 215/230 |
| 4,801,033 | 1/1989 | Kanner | 215/277 X |
| 4,830,209 | 5/1989 | Jessop et al. | 215/273 |

FOREIGN PATENT DOCUMENTS

| | | | |
|---|---|---|---|
| 273618 | 9/1964 | Australia | 215/274 |
| 25508 | 1/1884 | Fed. Rep. of Germany | 215/278 |
| 45047 | 11/1910 | Fed. Rep. of Germany | 215/290 |
| 467036 | 6/1914 | France | 215/278 |
| 1006410 | 4/1952 | France | 215/278 |

*Primary Examiner*—Tom Noland
*Attorney, Agent, or Firm*—Lynn G. Foster

[57] ABSTRACT

Fail safe releasible locks for capped centrifuge containers to insure closure integrity against specimen loss in whole or in part, the containers with cap being suitable for use in centrifuging and/or boiling liquid specimens and, if desired, for removal of processed specimens without removal of the lock and without opening of the cap.

4 Claims, 4 Drawing Sheets

FAIL SAFE RELEASIBLE LOCKS FOR CAPPED DISPOSABLE CENTRIFUGE CONTAINERS

CONTINUITY

This application is a division of our copending U.S. patent application Ser. No. 191,518, filed May 9, 1988, now U.S. Letters Pat. No. 4,830,209.

FIELD OF INVENTION

The present invention relates generally to disposable laboratory testing devices, and more specifically to fail safe releasible locks for relatively small capped centrifuge containers.

PRIOR ART

The need for centrifuging certain specimens, within the scientific community, in conventional processes of analysis has long been prevalent. In the medical community, this need often arises in conjunction with scientific research directed to finding a cure for a known disease, or in conjunction with a diagnosis of a specific patient's condition, through specimen analysis. In either case, disposable centrifuge containers are required and must be of a type comprising a cap or other closure. The problem is that the integrity of the seal between the container and the end closure sometimes fails under intense centrifugal force or when the container, with the specimen therein, is boiled. Thus, the specimen or part of it is undesirably lost from the interior of the container.

Without closure integrity, researchers and medical personnel are exposed to many extremely harmful or even lethal organisms, such as the AIDS virus. Radioactive contamination of medical personnel is a further risk. Other persons may be inadvertently exposed as well, and large areas could become contaminated. Furthermore, the accuracy of specimen testing is often tied to the exact volume of the specimen undergoing testing. When part of the volume is lost during testing because the lid or closure of the container or tube leaks, the accuracy of the test is lost. With these matters in mind, it is not only vital to maintain the integrity of the seal between the container and its closure but it is also highly desirable to have a container that is readily ascertainable to be in a fail safe sealed disposition.

Coupled with the need for closure integrity of a centrifuge container is a heretofore unfilled need for a container closure system that is readily opened when not being centrifuged or otherwise being processed in order to allow facile access to the interior of the container. This quality, allowing ease of initial introduction of a specimen and subsequent ease of controlled withdrawal of all or a selected part of the specimen or sample, also helps to prevent the inadvertent spillage of the contents of the container resulting from the use of extra force in opening the container.

Also a need exists by which the container closure (cap) is marked for purposes of identification, such that the marking will not inadvertently be removed, obliterated or hidden from view. A still further desirable feature of such containers is that, independent of the nature of any fail safe lock by which the container and cap are held securely together during processing, the container and cap should be permanently interconnected to prevent inadvertent misplacement of the cap.

Prior art containers with removable closure lids have been used for many years to perform centrifuging and boiling as part of laboratory testing procedures. These have been lacking in some important areas. The two most significant limiting areas are closure integrity and the ability to accurately and immediately ascertain when the closure is fully sealed. Some prior art containers have failed to maintain closure integrity during specimen processing, and some do not advise the laboratory technician when the seal has been maintained.

With an increasing concern for the hazards of scientific research and the need for accuracy through preservation of the volumetric integrity of specimens placed in centrifuge containers, the foregoing concerns constitute problems not solved by the prior art which are addressed by the present invention.

BRIEF SUMMARY AND OBJECTS OF THE INVENTION

In brief summary, the present invention is directed to fail safe releasible locks for closures of disposable centrifuge containers suitable for safe, leak-free boiling and centrifuging in scientific or laboratory testing so as to preserve the volumetric integrity of small samples. Fail safe releasible locks for specimen containers, in accordance with the principles of the present invention, are manually fitted over the contiguous lips or flanges at the outside of the open top of the container thereof and at the cap in such a way as to create a lock against specimen leakage during centrifuging and boiling. The mentioned locking phenomenon may be accompanied by an audible signal which verifies to the laboratory technician that the lock is securely in place and the cap is being retained in a tightly sealed condition against the tube. The lid or cap is preferably tethered or otherwise yieldably connected to the container or tube near the top opening. The lock may be free from or tethered to the container or the cap. Placement of the lock in respect to the centrifuge container and the cap allows for marking earlier placed on the top of the cap to remain plainly visible. It also provides for penetration of a central part of the preferred cap by a piercing instrument whereby access to a processed specimen is accommodated without removal of the releasible lock and without opening of the cap. Locks according to the present invention may be disposable items which are discarded after one or a few uses.

With the foregoing in mind, it is a principal object of the present invention to provide a novel lock for maintaining a seal between a centrifuge container and a cap or other closure for the container to prevent specimen leakage, and related methods.

It is a further significant object to provide a novel releasible lock for a centrifuge container that insures the integrity of the seal between the lid and the container against specimen leakage.

It is another primary object of this invention to provide a novel releasible fail safe lock for a centrifuge container and its lid wherein the user is signaled when the lock is fully in place, thereby maintaining a leak proof seal between the container adjacent the top thereof and the container lid.

It is a further dominant object of the invention to provide a novel disposable fail safe lock for locking together a centrifuge container and its openable/closable lid in a sealed leak-free condition, wherein the lock can be manually placed and removed by the user with ease.

It is another important object of this invention to provide a novel lock for holding a centrifuge container in sealed relation with its lid, which does not conceal an indicia-receiving surface at the top of the lid.

It is a further valuable object of the invention to provide a novel lock for holding a centrifuge container to its closure cap in sealed relation, wherein the lock is tethered to the container or the closure cap.

A further dominant object is the provision of a novel release lock which holds a centrifuge container to its lid or closure in a closed sealed condition securely against specimen leakage during centrifuging and boiling.

A further consequential object is the provision of a novel lock by which a specimen container and its lid are held in a closed sealed relation so that contamination of medical testing personnel by microorganisms, leakage, radioactive leakage and the like is avoided.

It is still another paramount object to provide apparatus and method whereby a releasible lock holding a cap in a fail safe sealed relationship with a centrifuge tube may be retained in its locked condition after processing accommodating access to the processed specimen through a hole pierced in the cap following processing.

These and other objects and features of the present invention will be apparent from the detailed description taken with reference to the accompanying drawings.

DETAILED DESCRIPTION OF THE ILLUSTRATED EMBODIMENT

Reference is now made to the drawings, wherein like numerals are used to designate like parts throughout. Specific reference is made to FIGS. 1, 2 and 3 which comprise perspective representations of centrifuge container assemblies, designated generally 10, 12, and 14, respectively. All three container assemblies are similar, each being illustrated as comprising a tube and having the same cap closure system. Each container is illustrated as being generally cylindrical in shape. There are, however, some difference in these containers which will be described hereinafter. It is to be appreciated that the containers and lids therefor disclosed herein are exemplary. The present invention applies to almost all specimen container which have caps, plugs or lids for use in centrifuging and boiling testing processes.

Figure 2:
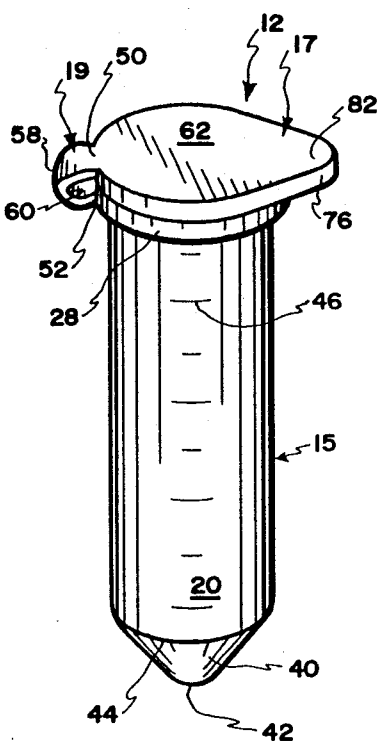
FIG. 2 is a perspective of another centrifuge container embodiment similar to the embodiment of FIG. 1 but having a visible volume scale along the container.
Figure 1:
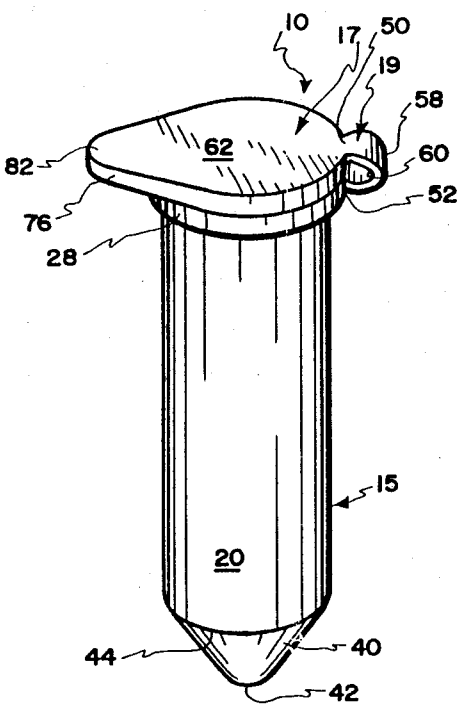
FIG. 1 is a perspective of a centrifuge container with a tethered cap illustrated as being disposed in its fully sealed position.

Each illustrated centrifuge container assembly, as aforementioned, is substantially cylindrical in shape. However, container assembly 14 (FIG. 3) differs from the other embodiments in that approximately one-half of the body length, the lower half, comprises an elongated cone, whereas the containers 10 and 12 have short bottom conical sections. These short conically-shaped bottom sections are illustrated in FIGS. 1 and 2, respectively.

The containers 10 and 12, with one exception, are identical. Each comprises a small tube or cylindrical container, generally designated 15, a cap or lid, generally designated 17, adapted to close upon the open top of the associated tube 15, and a tether, generally designated 19, by which the associated tube 15 and cap 17 are connected. The entirety of each disposable container assembly is formed as one piece from a suitable synthetic resinous material, such as polypropylene, using known injection molding techniques.

Each tube 15 comprises a central elongated hollow cylindrical wall 16, which is illustrated as being of uniform thickness throughout. See FIGS. 4–6. Wall 16 thus comprises inside annular surface 18 and outside annular surface 20. Each cylindrical wall 16 is illustrated as integrally merging at its upper end with annular flange and lip structure comprising an outwardly extending radial directed flange or ring 22 and an inwardly extending radially directed annulus or lip 24.

Each ring 22 is illustrated as being sized to be radially flush with the exterior annular edge of the associated cap and comprises seriatum flat bottom surface 26, cylindrical edge surface 28, top flat surface 30 and interior annular surface 32. Adjacent surfaces 26, 28, 30 and 32 are illustrated as merging with each other at 90° angles. Thus, the ring 22 is generally rectangular in cross section.

In contrast, annular inwardly-directed lip 24 is illustrated as essentially semi-circular, in cross section, and defined by a single arcuate external surface 34 which merges at the top thereof with the ring surface 32. The interior minimum diameter of the lip 24 is sized to contiguously interrelate with the associated lid 17, in a manner and for purposes hereinafter explained in greater detail.

The interior of the flange lip structure 22, 24 comprises a wide mouth top opening 36 to the hollow interior 38 of the tube 15 through which a liquid specimen, for example, may be introduced and at least part thereof removed after centrifuging.

The conical bottom of each tube 15 comprises a downwardly convergently tapered extension 40 of the wall 16 terminated in a closed lower tip 42. The lower end 40 is conically hollow between the annular merger site 44 with wall 16 and the tip 42.

The interior of each container is formed in such a way that liquid place to the same level in several identical containers will comprise the same liquid volume. Thus, graduation markings 46 may be placed upon the exterior surface 20 to accurately indicate the quantity of liquid existing therein at any point, as illustrated in FIG. 2.

Figure 7:
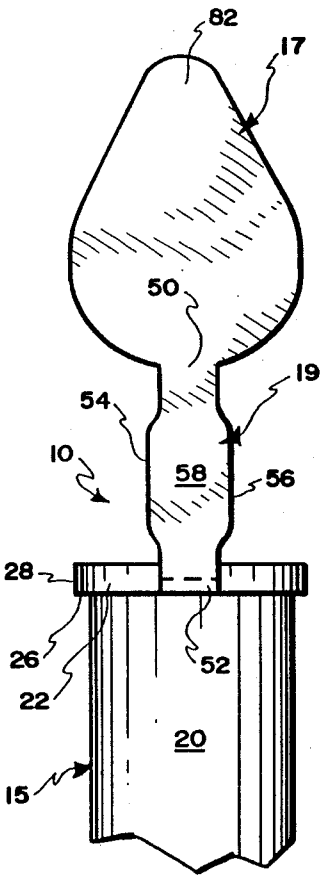
FIG. 7 is a fragmentary side plan view illustrating the preferred tether connector between a container and lid.
Figure 3:
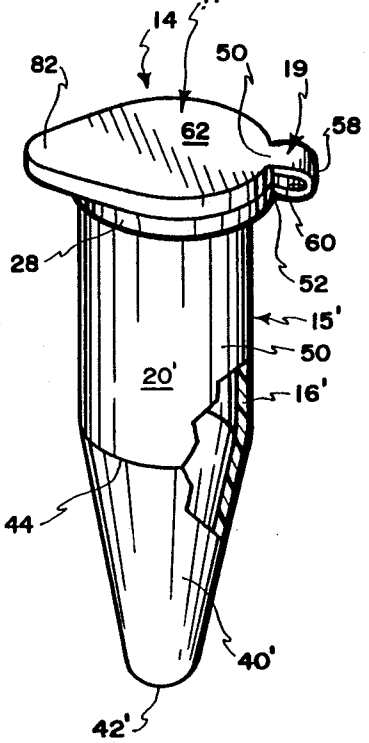
FIG. 3 is a perspective of still another centrifuge container similar to FIG. 1, this embodiment being somewhat more conically elongated at the bottom of the container with an etched area on the container above the conical bottom for receiving identifying indicia.

Also, the length of the cylindrical wall may be shorter and the lower conical end longer, as illustrated at wall 16' and conical section 40' of tube 15', in FIG. 3. The lower tip 42' is shown as being less pointed and more rounded.

The tube 15' of FIG. 3 is also illustrated as comprising a large etched or like writing surface area. This surface may comprise all or a large part of the entire exterior surface 20' of the wall 16', may be raised slightly from the rest of the exterior surface 20' of the tube 15' and comprises a roughened surface upon which identifying marks can be readily written with conventional instruments allowing for easy placement of identifying indicia on the container, while obviating inadvertent removal of the identification. Although the other containers are not illustrated as having the writing surface on the side, any container can be supplied with such a surface. Preferably, the writing surface and the volume graduations 46 are formed in the mold at the time the device is injection molded.

Present laboratory technology dictates that the usual volume of a container of the type disclosed herein be within the range of about 1.5 to 2.0 ml. However, the present invention applies to containers of greater or less volume.

Also, any container within the purview of the present invention may be supplied with graduation markings. These graduations may be in increments of millimeters or any other appropriate unit of measure to provide for easy determination of a specific sample volume. The graduation markings, similar to the writing area, may also be slightly raised from the rest of the exterior surface, and formed in the same manner as the writing surface 50, e.g. by etching. Although such graduations may be provided, it is not necessary to do so.

The upper ring/lip construction 22, 24, as well as the tether 19 and the cap 17 of all of the illustrated containers are shown to be identical and are so numbered in the drawings.

As shown in FIGS. 1–3 and 7, each cap 17 is joined to its associated cylindrical container 15, 15' by a tether 19. The tether 19 is preferably integrally molded with the associated cap 17 and container 15, 15'. The tether 19 is illustrated as being integral with the top region of the cap or lid 17 at site 50 and with the ring 22 of the container at site 52. The tether 19 is illustrated as having a thickness less than one-half of the container lip thickness. The thickness of the tether is to be such as to readily accommodate closing and opening of the lid, yet strong enough to prevent breakage.

Figure 4:
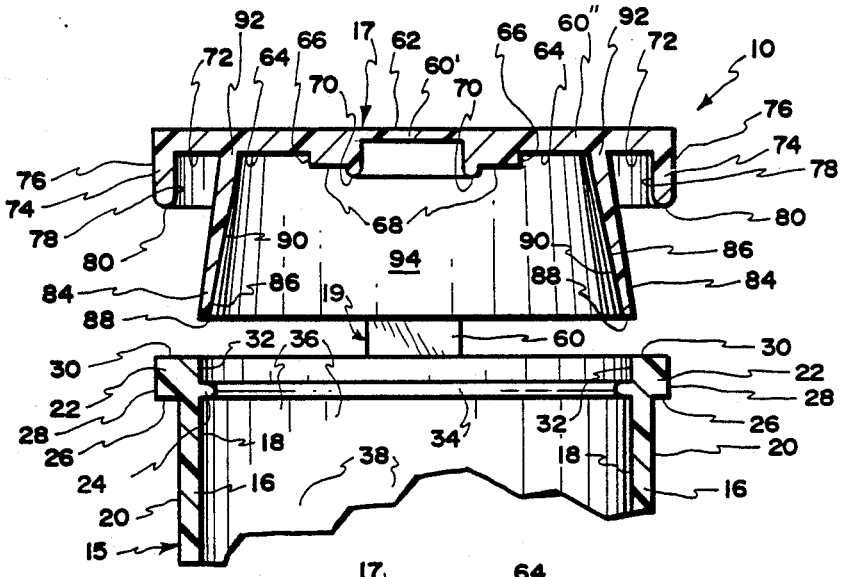
FIG. 4 is an enlarged fragmentary exploded cross-sectional view showing the cap in its open condition removed from the container

The flat tether 19 is comprised of side edges 54 and 56. It is further comprised of top surface 58 and bottom surface 60 (FIG. 4). The width of the tether is illustrated as being centrally enlarged. When the cap 17 is in the closed position, the strap 19 is folded or looped upon itself, as shown in FIGS. 1–3. On the other hand, when the cap is in the open position, the strap 19 maintains the connection between the cap and container, such that the cap can be positioned in a variety of positions but on no occasion does the cap become separated from the container. Due to the memory of the strap material, the cap 17, when disconnected from the cylinder, tends to return to a linear configuration.

The strap or tether 19 is shaped to allow the maximum efficiency in hinging capabilities. When the cap is closed, the strap 19 is transversely folded along the approximate midpoint thereof, and the major stress placed upon the strap occurs along this location. Therefore, the middle section of the strap is enlarged in its width to better tolerate the mentioned flexure. The strap is essentially flat, which also accommodates the stated flexure. Thus formed, the strap provides both a connection and hinging site for the cap 8.

Figure 5:
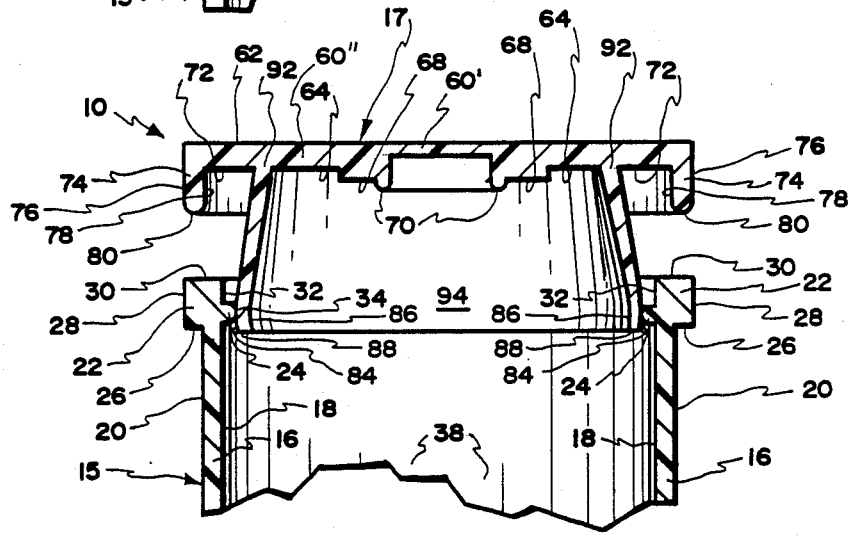
FIG. 5 is an enlarged fragmentary cross-sectional view similar to FIG. 4, but showing the cap in a second partially inserted position.
Figure 6:
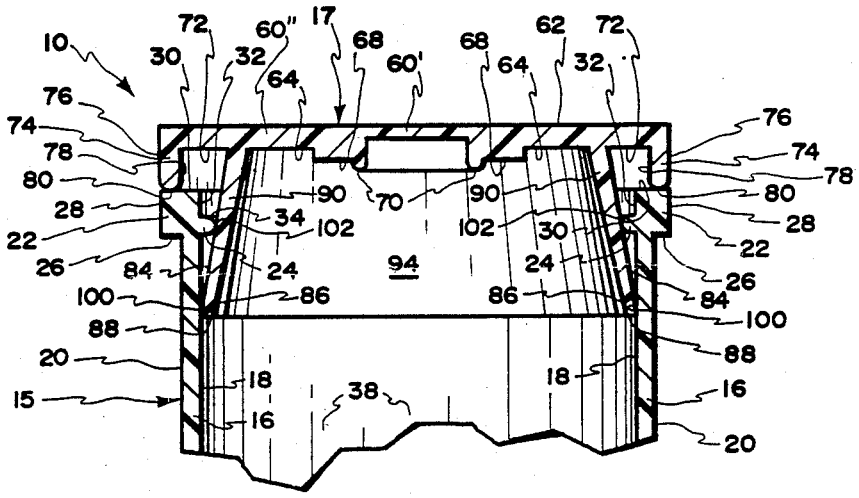
FIG. 6 is an enlarged fragmentary cross-sectional view similar to FIGS. 4 and 5, but showing the cap in its fully closed and sealed position.

The cap 17 is generally flat across the top thereof, but, as shown in FIGS. 4–6, the lower part thereof is essentially frusto-conical. More specifically, the cap or lid 17 comprises an exposed top wall 60'', which is teardrop-shaped as shown in FIGS. 1–3 and 7. Wall 60'' comprises a top exposed flat surface 62 and an underside surface 64 which is stepped at annular shoulder 66 to integrally merge with annular surface 68, which has an enlarged thickness. Surface 68 is interrupted by an integral reinforcing ring 70. The thin center 60' comprises a membrane or diaphragm for penetration of a hypodermic needle or other piercing instrument for a purpose hereinafter explained.

The wall 60'' also comprises a teardrop-shaped undersurface 72. Teardrop-shaped wall 60'' is flanked by a downwardly-directed edge flange wall 74 comprising outside wall surface 76 and inside wall surface 78. Flange wall 74 is illustrated as being of uniform thickness, extends through the same teardrop configuration as does wall 60'' and terminates in blunt edge 80. Walls 60'' and 74 are integral and transverse to each other and are illustrated as being formed so that surfaces 62 and 76 and 72 and 78, respectively, intersect at 90° angles.

The flange wall 74 is formed so that when the cap is in the closed position, as illustrated in FIGS. 1 through 3, the elongated tip 82 of the cap extends beyond the lip 22 of the container 82 to allow the user to easily force the lid 17 upward to open the container. This is accomplished by exerting an upward pressure on the cap at the point where the elongated tip 82 extends beyond the ring 22 of the container, thus opening the cap. The remainder of the outer edge 80 of the cap 17 rests contiguously on the upper edge 30 of the container 15. Except for the tip 82, the outer edge surface 76 of the cap is of substantially the same transverse dimensions as surface 28 of the lip 22 of the container 15.

A downwardly divergently tapered frusto-conical wall or skirt 90 is located between wall surfaces 64 and 72 and is integral with wall 60''. Wall 90 forms an overall frusto-conical cupular structure comprised of an interior surface 86, an exterior surface 84, and a lower rounded edge 88. This cup or skirt structure is attached to the cap top wall at an annular site 92 approximately half way between the inner surface 78 shoulder 66.

The annular wall of the cup-shaped structure is thicker at site 92 (the juncture point with the cap top wall 60'') than it is at the edge 88. The wall, therefore, gently and uniformly convergently tapers from top to bottom. The wall 90 is illustrated as being approximately twice as thick at site 92 than it is at the edge 88. The length of the wall 90 is great enough to form the two annular seals, as discussed hereinafter, that length being substantially greater than the thickness of the cap-supporting lip 22.

The exterior diameter of the wall 90 at the leading edge 88, as well as the exterior diameter beginning at edge 88 and extending along a substantially length of the exterior wall 84, is somewhat greater than the interior diameter of the cylindrical container 15 at surface 18. However, the exterior diameter of the ring at site 92 is somewhat less than the interior diameter of the cylindrical container 15 at surface 18.

The walls 60 and 90 form a hollow frusto-conical recess 94 within wall surface 86.

FIGS. 4, 5, and 6 illustrate the process of closing the cap 17 by which a double seal is created. FIG. 4 shows the cap 17 in aligned relationship to the container in an open, uncapped position. As downward manual pressure is exerted on the top surface 62 of the cap wall 60, the leading edge 88 of the conical cup-shaped closure ring wall 90 will constrict somewhat and come to rest on the top of lip 24. This is a first temporary sealed position.

When downward manual pressure is continued to be exerted on the cap 15, the leading edge 88 and adjacent wall structure partially collapse and further constrict as edge 88 enters the constriction formed by lip 24. Restated, the entire leading edge 88 of the cup-shaped closure ring first contacts lip 24 and thereafter is radially compressed or constricted as the edge 88 and the adjacent wall structure are forced through the opening within lip 24. See FIG. 5.

Application of continuing manual force upon the lid wall 60 causes the edge 88 and adjacent wall to pass through the annular lip 24. The double seal thus formed results from outward radial pressure exerted by the memory of the material comprising the cup-shaped closure ring wall 90. One seal exists at annular interface 100 (where edge 88 engages wall surface 18) and the other at annular interface 102 (where surface 84 engages lip 24).

The completely closed position, forming the aforesaid two annular seals 100 and 102, is illustrated in FIG. 6. The annular seal 102 formed between wall surface 84 and lip 24 is approximately at the vertical midpoint of the frusto-conical wall 90.

Specific reference is now made to FIGS. 8–12, which illustrate a presently preferred releasible lock embodying the principles of the present invention. More specifically, the releasible lock of FIGS. 8–12, generally designated 110, has a horseshoe configuration and a fore-to-aft length which exceeds the distance from the tip 82 of the cap 17 to the center of the container 15. The interior width of the lock 110, in an unstressed state, is slightly less than the diameter of the container 22. The cross-sectional configuration of the lock 110, which is designed to be laterally inserted upon the lid and the container, is channel shaped, i.e. U-shaped disposed in a vertical orientation as illustrated in FIGS. 8–12.

Preferably, the lock 110 is formed of polypropylene or polystyrene, as a single piece using a well known one shot injection molding technique. The polypropylene may be that which is available from Ashland Chemical Company and may be reground polypropylene since the plastic of the lock 110 is at no occasion placed in contact with the liquid specimen contained in the container per se. The horseshoe-shaped lock 110 comprises a top curvilinear flange 112 and lower curvilinear flange 114. Flanges 112 and 114 are identical, but of opposite hand. Each Flange 112 and 114 is enlarged in the region of the proximal tip 115 to better accommodate placement over the tip 82 of the cap 17. The flanges 112 and 114 and the lip edges 116 and 118 preferably accommodate a snug fit when the clip or lock 110 is inserted over the container lid and against the outside surface of the container in the manner illustrated in FIGS. 9 and 10. Preferably, the inside diameter of the opening created by lip 114 is slightly less than the outside diameter of the container 15. However, the holding engagement can be against the lip 28 of the container or against the wall and lip of the container.

Figure 9:
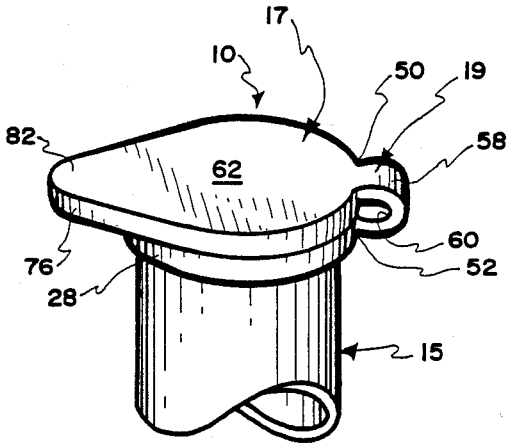
FIG. 9 is an exploded perspective of the releasible lock of FIG. 8 partially placed upon the container and its closed cap.
Figure 9:
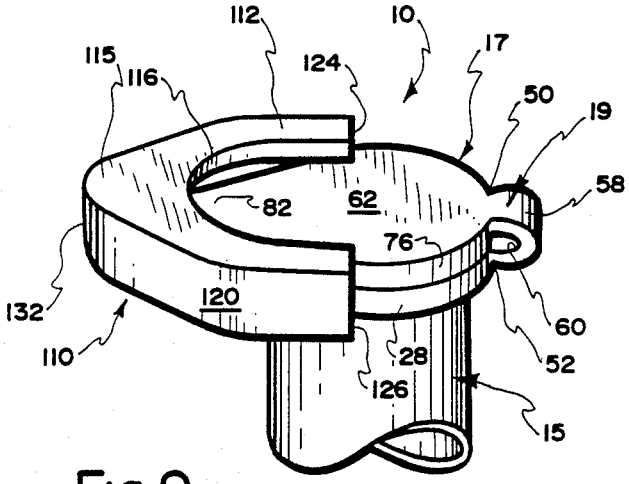
Figure 10:
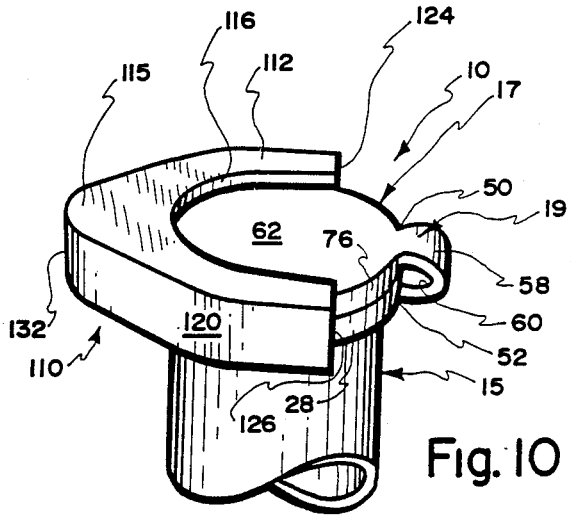
FIG. 10 is an exploded perspective of the releasible lock of FIG. 8 fully placed upon the container and its closed cap.
Figure 11:
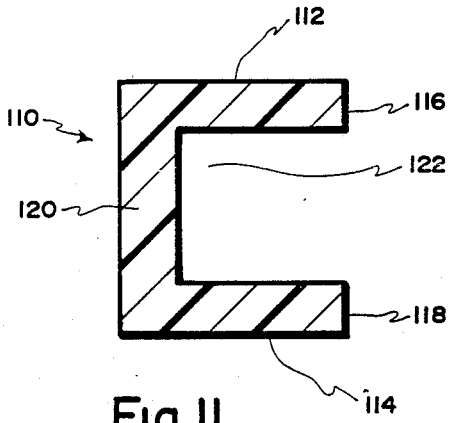
FIG. 11 is a cross-section taken along lines 11—11 of FIG. 8.
Figure 12:
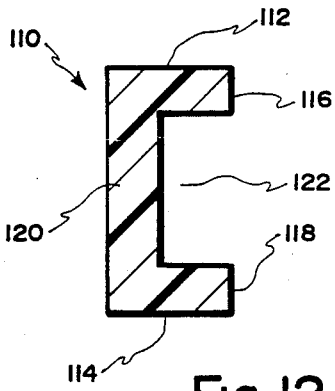
FIG. 12 is a cross-section taken along lines 12—12 of FIG. 8.

The top and bottom flanges 112 are integrally interconnected by a vertical wall 120, which is illustrated as being of uniform thickness and depth throughout. The wall 120 is integrally contiguous with the one edge each of the flanges 112 and 114. The thickness of the wall 120 is selected to provide structural integrity and the height is selected so that preferably a snug fit is created when the clip or lock 110 is inserted upon the container and lid, as illustrated in FIGS. 9 and 10. In this way, the lid and upper lip of the container are received in the recessed space 122 located to the rearward side of wall 120 between top and bottom flanges 112 and 114.

The variation in front-to-rear width of the flanges 112 and 114 creates a much larger surface area, in each case, toward the most central part 115 of the clip or lock 110. As stated, this design is particularly intended to accommodate receipt of the projection 82 of the lid 17 in the recess area 122 without compromising the fail safe nature of the lock when fully inserted upon the container and its lid, as illustrated in FIG. 10.

As mentioned earlier, the front-to-rear distance of the clip or lock 110 is preferably selected so as to extend beyond the midpoint of the container 15 when fully inserted as illustrated in FIG. 10. This, in effect, locks the jaws of the horseshoe-shaped lock 110 against inadvertent lateral displacement while creating a fail safe union against rotational displacement of the cap 17 out of its closed and sealed relationship with the upper end of the tube 15. Thus, the end edges 124 and 126 are disposed opposite each other in a common although nonradial plane. The clip or lock 110 may be dimensioned so that when the lock 110 is inserted in a manner illustrated in FIGS. 8–10, upon reaching its fully installed position, the opposed jaws or arms of the clip ending in end edges 124 and 126 close quickly and audibly against the adjacent edge of the lid and container upper lip so that the user is informed by the noise so emitted that the lock 110 is in its fully inserted position. The manual insertion of the lock 110 is accomplished facilely and with minimal manual effort, yet the lid and the container are securely locked one to another by the clip or lock 110 against specimen leakage during centrifuging and boiling. By the same token, manual lateral displacement of the lock 110 from its fully installed position of FIG. 10 to its removed condition of FIG. 8 can be facilely and swiftly accomplished by the user, when the specimen within the container 15 has been fully processed and it is desired by the user to have access to the processed specimen. Furthermore, the injection molded nature of the clip or lock 110 is relatively inexpensive so that it is not necessary for the lock to be reused, although that option is available to the user. Furthermore, the user has the option of choosing to use the lock 110 on all centrifuge containers or only selectively on those which are subjected to extraordinarily high centrifuge stress or high risk boiling techniques.

It is to be appreciated that the clip or lock 110 provides a further advantage, i.e. it allows a far greater range of choices in plastics from which the container 15 and its lid 17 may be formed, since maintenance of the closure between the lid and the container is not limited to the union created between those two parts but rather depends primarily and essentially upon the clip or lock 110. Thus, the cost of producing the container 15 and its lid 17 may be reduced by resorting to less expensive plastics, when used with a lock made pursuant to the present invention. Furthermore, it is commonplace for medical technicians and others to write data or indicia upon the exposed surface 62 of the lid 17. The construction of the clip or lock 110 preserves visual observation of any data or indicia so placed upon the surface 62.

It is to be appreciated that upon removal of the releasible lock 110 from a cap and container having a processed specimen therein, the cap can be manually opened from its interference-fit closed condition. This action sometimes results in displacement or spillage of some of the specimen, risking contamination and inaccuracy in the test results. To avoid such specimen spillage, the present invention contemplates leaving the releasible lock 110 in place after the specimen is has been centrifuged, boiled and the like and drawing the processed specimen through a hole made by a hypodermic needle or other piercing instrument in the diaphragm 60' of the cap 17 just prior to specimen removal. Specimen removal can be via the hypodermic needle when attached to a syringe or by removing the piercing instrument from the hole and passing a micropipette tip through the hole.

Figure 15:
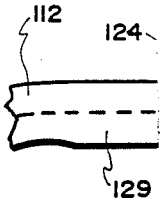
FIG. 15 is a fragmentary plan view taken along lines 15—15 of FIG. 13.
Figure 14:
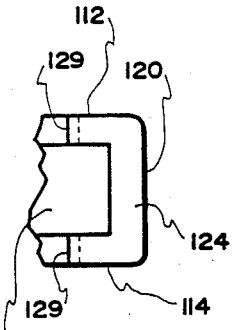
FIG. 14 is a fragmentary end view taken along lines 14—14 of FIG. 13.
Figure 13:
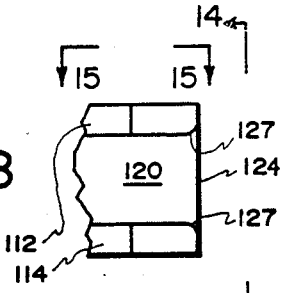
FIG. 13 is a fragmentary side elevation of another releasible lock embodiment wherein the ends of the horseshoe lock have rounded edges to aid in placing the lock over the flanges of the lid and container.

As illustrated in FIGS. 13–15, the flanges 112 and 114 adjacent ends 124 and 126 may be modified for better placement and improved retention. More specifically, each end 124, 126 may comprise round flange edges 127 which make insertion of the clip or lock 110 upon the container and its lip, as described, easier. Furthermore, the distal end of each flange may be widened at site 129 to provide a greater gripping surface area and greater resistance to removal from the fully installed position. The existence of enlargements 129 aids in creating an audible snap which the lock is fully inserted especially if the lock is formed of polystyrene.

Figure 8:
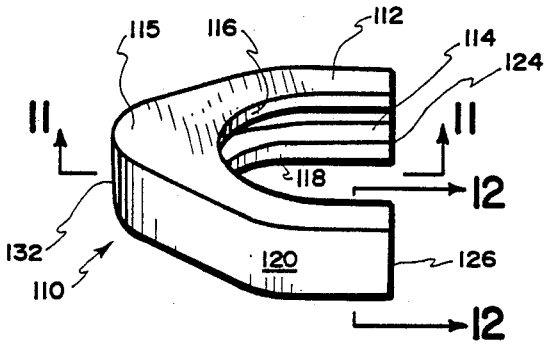
FIG. 8 is an exploded perspective of a releasible lock, according to the present invention, about to be placed upon a container and its closed cap.
Figure 16:
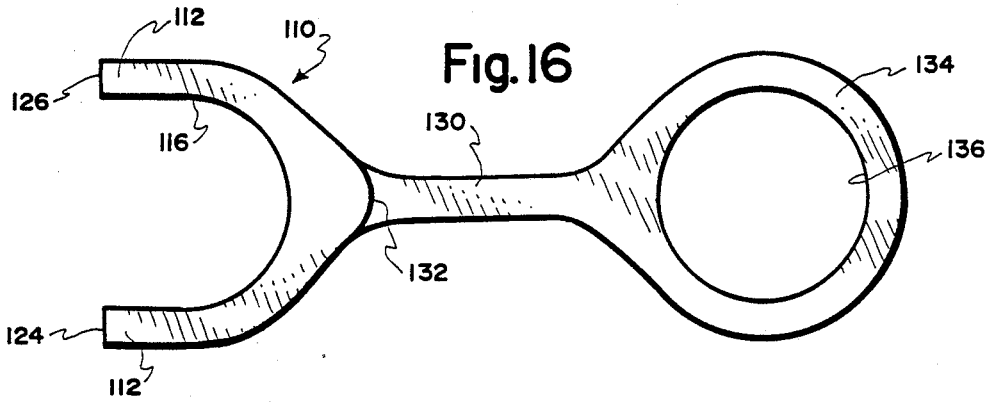
FIG. 16 is a plan view of another releasible lock according to the present invention, having a tether for container engagement.

Reference is now made to FIG. 16 which illustrates a modification of the lock 110 whereby a tether 130 is integrally joined with the leading nose 132 of the lock 110. The tether 130 preferably is injection molded integrally with the lock 110 as is opposed loop 134, which has a central opening 136 sized to be substantially the same as or slightly less than the diameter of the container 15 whereby the loop 130 is force-fit over the container 15 in a direction from the top toward the bottom. Thus, the lock 110 is tethered or united with the container 15 against inadvertent loss. The user, therefore, is not required to locate the lock 110 when its use is desired, but rather will have the lock 110 tethered to the container for immediate use. It should be apparent that the length of the tether 130 should be such as to comfortably accommodate placement and removal of the lock 110 on the upper end of the container 15 and its cap 17, as illustrated in FIGS. 8–10, but not so bulky as to encumber the placement of the container 15, lid 17 and lock 110 in laboratory processing locations. Preferably, the embodiment of FIG. 16 is formed as one piece using a single shot conventional injection molding technique and comprises polypropylene or polyethylene synthetic resinous material.

Figure 17:
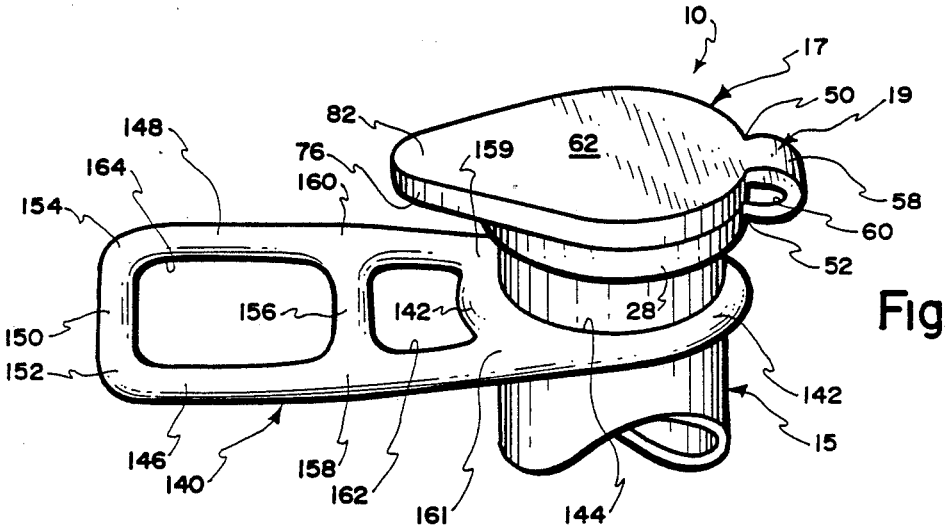
FIGS. 17 and 18 are a perspective of another releasible lock according to the present invention in its tethered open and closed positions, respectively.
Figure 18:
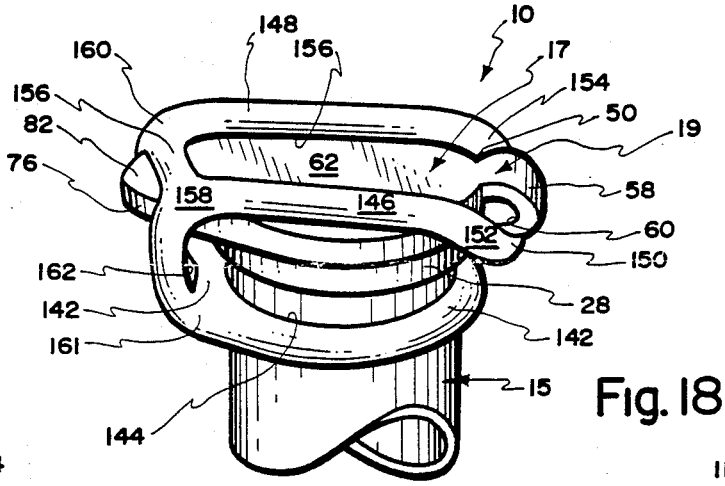

Reference is now made to FIGS. 17 and 18, which illustrate still another releasible lock embodiment fashioned in accordance with the principles of the present invention. The releasible lock of FIGS. 17 and 18, generally designated 140 comprises a multiple loop formed of synthetic resinous material such as polypropylene. The multiple loop releasible lock 140 comprises a proximal loop 142 having an internal opening of 144 which is preferably slightly less than the diameter of the container over which it is force-fit into the position illustrated in FIG. 17. In this way, the releasible lock devise 140 is tethered or anchored to the container 115 and need not be found separately each time use is desired. It is to be appreciated that releasible locks in accordance with the present invention may be made integral with the container 15 or the lid 17 to the same end, to provide interconnection independent whether or not the releasible lock so interconnected is in its open or closed disposition.

The multiple loop releasible lock 140 further comprises spaced arms 146 and 148. The arms 146 and 148 are interconnected by distal end cross-bar 150 via right angle corners 152 and 154, respectively. Similarly, arms 146 and 148 are interconnected at an intermediate location by cross-bar 156 at Tee sites 158 and 160, respectively, and at loop 142 at Tee sites 159 and 161, respectively. Thus, the multiple release lock 140 comprises three loops, i.e. loop 142, explained above, which accommodates interference-fit placement of the lock 140 upon the container 15, and intermediate loop 162 which is sized to accommodate rotational placement, under somewhat elasticized and stressed conditions of the cross-bar 150 over the top of the lip 82 of the lid 17 to hold the same tightly in a downward position and third somewhat larger loop 164, sized and shaped to accommodate stressed placement of the distal cross-bar 150 over the cap tether 58 so as to be secured below the tether 58 at site 52. The closed position of the releasible lock 140, manually obtained, is illustrated in FIG. 18. This position causes the lid 17 to be imperviously disposed against the upper end of the container 15 so that specimen leakage is prohibited. Nevertheless, the lock 140 may be readily placed in the closed position of FIG. 18 or manually removed from the closed position of FIG. 18 to the open position of FIG. 17 with limited manual exertion in a facile manner so that virtually no appreciable time consumption occurs.

Again, as explained above, releasible lock 140 may be left in place over the cap, as shown in FIG. 18, after the liquid specimen in the container has been centrifuged, boiled or the like and the processed specimen removed not by opening the cap but via a hole created in the cap for that purpose after processing.

The invention may be embodied in other specific forms without department from the spirit or essential characteristics thereof. The present embodiments, are, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by U.S. Letters Patent is:

1. A releasible lock for holding a capped liquid specimen container in a leak-free closed state during centrifuging, boiling and like processing in a specimen testing laboratory, the releasible lock being formed as one piece of synthetic resinous material with memory and comprising (a) first means to restrainingly engage a closed cap to prevent cap movement in a direction away from a liquid specimen container having an opening at one end which is closed by the cap, (b) second means to restrainingly engage the container adjacent said opening and (c) third means integrally interconnecting the first means to the second means in such a way that the memory of the third means retains the aforesaid engagements prohibiting loss of any portion of the liquid specimen through the opening and across the cap during boiling and centrifuging and whereby the releasible lock can be manually force into the leak-free closed state or removed by the user as desired, the first and second means comprising spaced elongated cross members and the third means comprise parallel spaced longitudinal members.

2. A releasible lock for holding a capped liquid specimen container in a leak-free closed state during centrifuging, boiling and like processing in a specimen testing laboratory, the releasible lock being formed as one piece of synthetic resinous material with memory and comprising spaced elongated cross members respectively engaging the cap and lip means at one end of the container adjacent a container opening and spaced parallel longitudinal members connected to the cross members such that the memory of the longitudinal members causes said engagements to be maintained prohibiting loss of any portion of the liquid specimen through the opening and across the cap during boiling and centrifuging and whereby the releasible lock can be manually forced into the leak-free closed state or removed by the user as desired.

3. A releasible lock according to claim 2 wherein the cross members and longitudinal members form at least two loops and three cross members.

4. A releasible lock according to claim 2 further comprising means by which the lock is tethered to the container.

* * * * *